US005133396A

United States Patent [19]

Selak et al.

[11] Patent Number: 5,133,396

[45] Date of Patent: Jul. 28, 1992

[54] LABEL FEEDING MACHINE

[75] Inventors: Martin M. Selak, Mount Prospect; George Selak, Streamwood; Pawel Pach, Schaumburg, all of Ill.

[73] Assignee: Astro Machine Corporation, Elk Grove Village, Ill.

[21] Appl. No.: 616,104

[22] Filed: Nov. 20, 1990

[51] Int. Cl.[5] ..... B65H 26/00

[52] U.S. Cl. ..... 156/361; 156/540; 156/542; 209/900; 250/561

[58] Field of Search ..... 156/360, 361, 350, 351, 156/540, 541, 542, 362, 363; 209/900, 576, 3.1, 3.2, 3.3, 551; 250/561, 571

[56] References Cited

U.S. PATENT DOCUMENTS

| | | | |
|---|---|---|---|
| 3,435,243 | 1/1966 | Webb | 250/561 |
| 3,721,601 | 3/1973 | Pituch et al. | 156/542 |
| 4,188,252 | 2/1980 | Brown | 156/542 |
| 4,601,394 | 6/1986 | Hutner | 209/900 |
| 4,639,287 | 1/1987 | Sakura | 156/542 |
| 4,954,203 | 9/1990 | Matsumoto | 156/361 |

*Primary Examiner*—David A. Simmons
*Assistant Examiner*—Robert Barker
*Attorney, Agent, or Firm*—Wallenstein, Wagner & Hattis, Ltd.

[57] ABSTRACT

A label-attaching machine for attaching labels carried on a partially transparent dispensing web for attachment to serially presented envelopes has a two-beam optical sensing unit to govern the synchronization of label feeding by determining the location of the leading edge of the next label to be dispensed. One beam senses the optical transmission of label-bearing regions of the web, and the other beam reads the optical transmission of label-free used web. A comparator circuit balances the signal strengths of the two beams to provide a signal condition indicative of label edge passage. A zip code sort is provided for use in conjunction with the same optical sensor. Labels of a common zip code are serially affixed to the web, and the arrival of a new zip code is flagged by an oversize gap between the last label bearing one zip code and the next label bearing the first of the new zip codes. A feed control system responsive to the optical sensing system responds to the long duration sensing of a long web gap to govern suitable sorting systems. A movable label dispensing head carries one of a pair of label-affixing pinch rollers through an arc to provide a controllable separation between the two pinch rollers, and a resilient biasing spring returns the upper pinch roller into secure contact with the media passing thereby. Media feed jamming in the case of thick media and small pinch rollers is thereby minimized.

7 Claims, 10 Drawing Sheets

LABEL FEEDING MACHINE

DESCRIPTION

1. Technical Field of the Invention

The technical field of the invention is machinery for attaching labels to sequentially passing sheet materials such as envelopes or the like.

2. Background of the Invention

Automatic mailing operations frequently employ pre-printed address stickers releasably adhesively secured to a dispensing web. The exemplary material to be described, e.g., envelopes, are sequentially passed forward by automatic transport mechanisms, and individual address labels are sequentially peeled off of the web by drawing the leading portion of the web sharply around an arcuate lip of a label dispensing head so that the leading edge of each serially presented label is peeled from the web. Further movement of the web causes the remainder of the label to be fed against its associate envelope to be pressed into position by a pair of pressure rollers.

A great variety of control systems exist for timing the dispensing of individual labels so that when then peeled from the web, they are placed within a chosen location on each envelope. One approach is to allow envelopes to be fed at a uniform rate towards the pinch rollers, and to govern the speed of feed of the web so as to be identical with that of the speed of envelopes. Thus, as the labels are emplaced on the envelopes, the labels and the envelopes are traveling at an identical speed. Proper placement of labels in a chosen location a given distance from the leading edge of each envelope is governed by a timing system which causes the web to advance to the next label well before the next envelope arrives, and then to immobilize the label feed momentarily. Label feed is re-engaged at an appropriate time to secure proper label placement.

One problem encountered in prior art machines has to do with the means whereby the above-mentioned synchronization is achieved. One common method used to sense the arrival of the label edge at the outlet of the label dispensing head is to space the labels on a reasonably optically transparent or translucent web. A suitably positioned photosensor responds to light passing through the web between the labels, and when the transmitted light is further attenuated by the passage of a label, a control signal is generated to operate the synchronization system. Such prior art systems have the disadvantage that they must often be recalibrated when webs of substantially different optical absorption are loaded onto the machine.

Prior art label affixing machines are also known which will sort envelopes according to the address codes (ZIP codes) printed thereon. Appropriate sorting of envelopes according to zip code is carried out by using some form of optical character reader which reads each label as it passes by, and operates suitable sorting machinery so as to collect the envelopes in groups of common zip code, thereby reducing mailing costs. Such optical character readers are expensive, and a less expensive solution to this problem would be economically advantageous.

Finally, a problem arises in such machines when relatively small labels are to be applied to relatively thick items, such as magazines and/or catalogues. Machines dispensing labels from a web as described hereinabove must of necessity have a relatively small diameter pinch roller so as to positively secure each label to its associated spring-loaded magazine before it releases from the web. Small diameter pinch rollers have proven to be jam-prone when media having a thickness of the order of or larger than the roller radius are fed through the machine, since reliable lifting of such a spring-loaded pinch roller requires that the face of the media be sufficiently below the center line of the roller axis to provide a lifting torque. Thus, label affixing machines should be capable of accommodating media of considerably varying thickness from one run to the next. A more flexible machine design that would overcome this problem would again be economically advantageous.

The present invention is oriented towards a solution of all of the foregoing problems.

SUMMARY OF THE INVENTION

According to one feature of the invention, a dual reference beam optical sensor system is employed to determine label edge passage as the web is advanced. One transmission photosensor, preferably employing a light-emitting diode and a photo transistor, is disposed to measure changes in the light transmission through both the web and spaced labels in the central portion of the web. The light detected by this photo transistor is compared with the light detected by a second photo transistor receiving a second reference beam produced by a second light-emitting diode and passing through a portion of the web where no labels are emplaced. This second photosensing system gives an output indicative of the optical transmission properties of the web material alone. A suitable comparator compares the two reference beams on a difference basis so that over a large variation in web optical transmission a self-compensating action is secured to provide reliable indication of the passage of label leading and trailing edges without requiring recalibration. In the preferred form of the invention, this second photosensing system senses the label-free stripped portion of the web, and is disposed to sense the stripped web during its passage back to a take-up reel.

According to another feature of the invention, zip code sorting is secured by arranging the labels on the web in groups of a common zip code, i.e., all labels having a common zip code are contiguous on the web. The transition to a new zip code is flagged by an overly large gap between adjacent labels having a different zip code. Except for zip code boundaries, inter-label spacing on the web is held to a reasonably constant value. From the duration of the gap sensing by the photosensing means as related to the drive speed of the system, oversized gaps are immediately detected and suitable sorting mechanisms may be energized. In the exemplary form of the invention, this sorting is done by a simple machine shutdown, whereupon the operator removes the media of a common zip code and re-starts the machine again. It is equally evident that suitable automatically controlled sorting chutes may equally well be employed. Another way of providing location of the large code-flagging gaps is simply to command the printout of a blank label between labels of a different zip code, the blank labels being removed from the web by the operator prior to installation on the machine.

According to another feature of the invention, particularly applicable to machines having small-diameter, label-affixing pressure rollers, a pivoting label dispensing head is provided, actuated by a manually rotatable cam having a number of locking detents. Rotation of the cam from one detent to the next pivots the dispensing head to raise the small diameter upper pinch roller to a number of fixed positions of varying height above the lower pinch roller. A limited-motion resilient biasing system including a biasing spring is used to secure adequate pressure between the upper pinch roller and the medium supported on the lower pinch roller. No prior art known to the applicant provides such an adjustable spacing between the upper and lower pinch rollers.

Other advantages and aspects of the invention will become apparent upon making reference to the specification, claims, and drawings to follow.

DESCRIPTION OF EXEMPLARY FORM OF INVENTION

Figure 1:
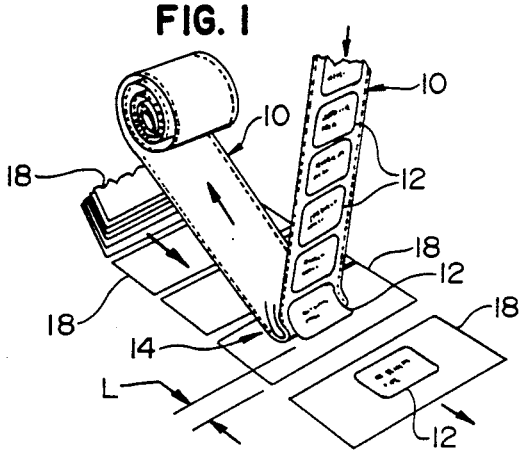
FIG. 1 is a generally schematic view showing a series of address labels releasably adhesively secured to a dispensing web being sequentially dispensed and affixed to envelopes.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspects of the invention to the embodiments illustrated.

The machine to be described herein is designed to apply labels bearing printed indicia thereon, as for example addresses, to sequentially fed media. The discussion to follow will be particularized to media in the form of envelopes; however, it will be understood that the broadest aspects of the invention are applicable to many other forms of media, e.g., circulars, magazines, and similar items.

Referring now to the figures, FIG. 1 shows in functional form a web 10 bearing sequential labels 12 releasably affixed by a suitable release adhesive thereto. The web 10 is folded around in a rearward direction around an arcuate dispensing lip 14 causing the leading edge of a label 12 to be dispensed in the forward direction. Envelopes 18 are serially passed under the dispensing lip 14, and each envelope 18 then has a label 12 emplaced thereon. Label pressurization to the envelopes 18, as well as web feed and take-up and envelope forward feed, are done by a system of coupled pressure rollers, as will be discussed.

Figure 2:
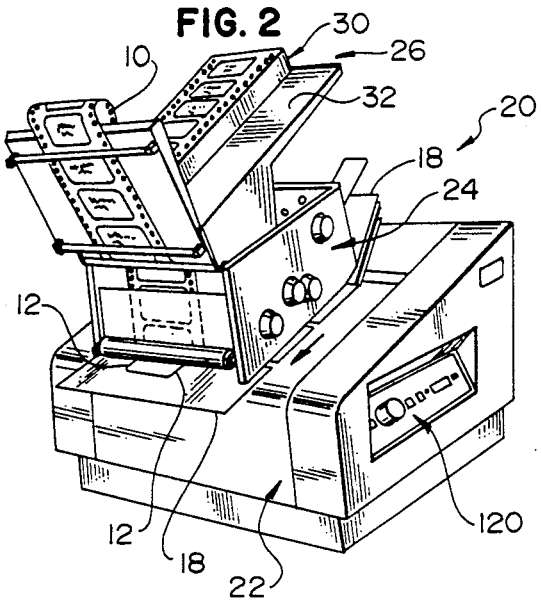
FIG. 2 is a perspective view of a label affixing machine of the invention for applying labels in the manner shown in FIG. 1.
Figure 3:
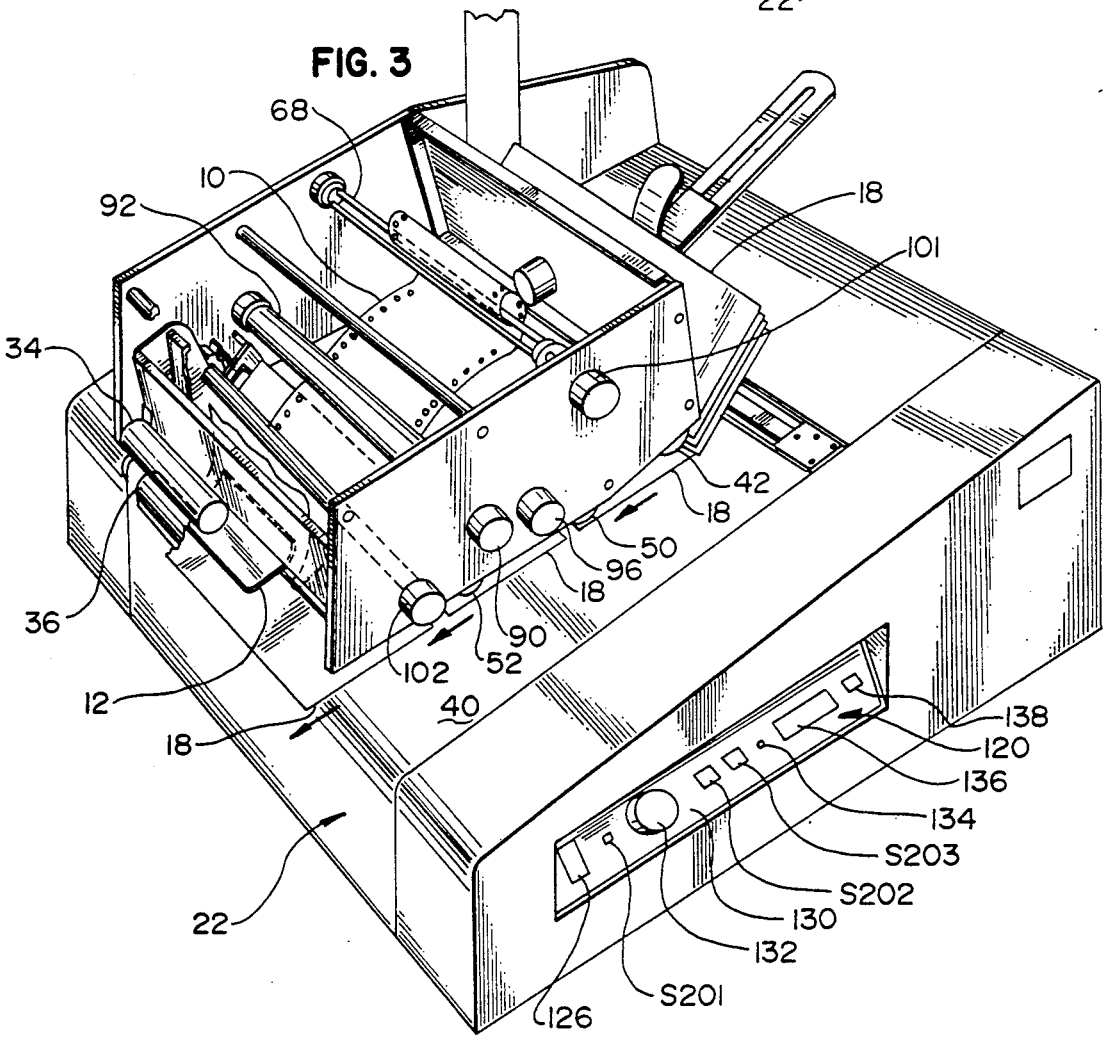
FIG. 3 is a large perspective view of the machine as shown in FIG. 2 with portions of the upper structure removed.

FIG. 2 shows a label attachment machine 20 comprising a lower housing 22, surmounted by an upper roller assembly 24 carrying a label hopper assembly 26. In the particular version of the invention shown in FIG. 2, the label web 10 is carried in back-and-forth folded form as a stack 30 carried on a tray 32. As can be seen in FIGS. 2 and 3, pressure is applied to secure individual labels 12 to individual envelopes 18 by upper and lower exit pinch rollers 34,36.

Figure 4:
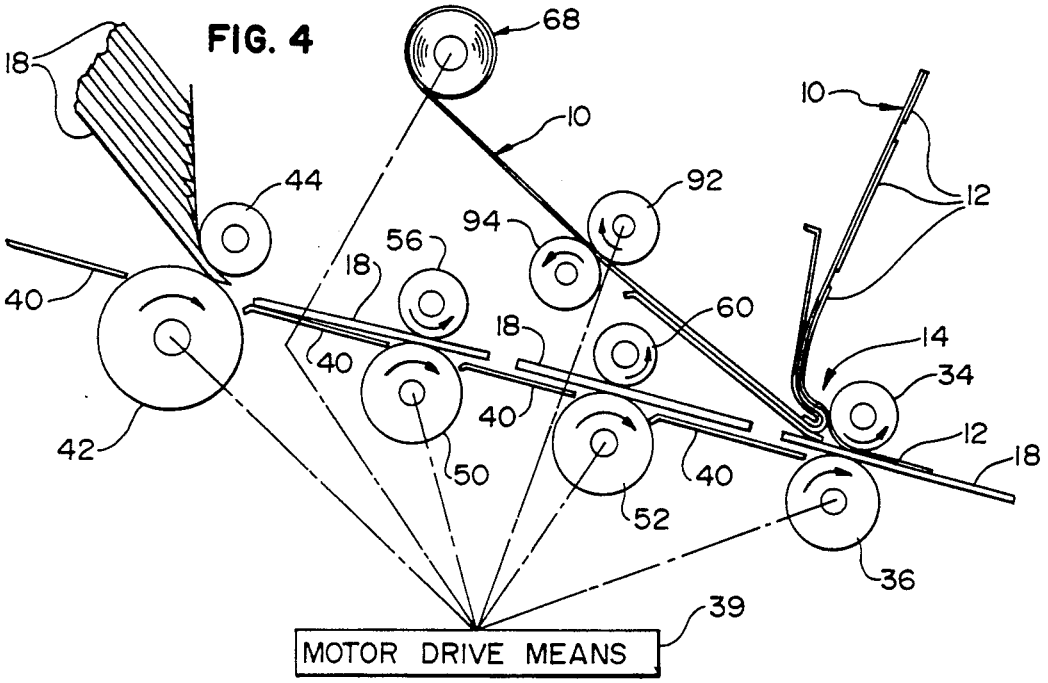
FIG. 4 is a generally schematic view showing the various coupled drive rollers used for moving the label-bearing webs and envelopes shown in FIG. 1.

FIG. 4 shows in functional form the series of driven and idler rollers used for web and envelope feed and powered by motor drive means 39. The envelopes 12 are serially withdrawn from a media dispensing tray 36 (FIG. 3) along a dispensing table 40 by a powered entry roller 42 confronting a stationary cylinder 44 having a pre-set standoff distance from the entry roller. The envelopes 12 are propelled towards the front of the machine by powered intermediate rollers 50,52 surmounted by intermediate idler rollers 56,60 respectively. The envelopes 12 are then passed through the upper and lower exit rollers 34,36. The lower rollers 50,52, 36 are positively driven at identical peripheral speed from motor drive means 60. The entry roller 42 is positively driven at a lower peripheral speed than the remaining powered rollers 50,52,56 so as to ensure that successive envelopes 12 have gaps 64 between them. The label-bearing webs 10 are moved, as previously described, around an arcuate dispensing lip 14. The web 10 is advanced towards a slippingly driven take-up reel 68 by a positively driven label feed roller 92 opposed by a spring-loaded idler roller 94. The label feed roller 92 is driven at identical peripheral speed as the powered rollers 50,52,36, thereby dispensing labels 12 out onto envelopes 18 at a speed identical with envelope speed.

Figure 6:
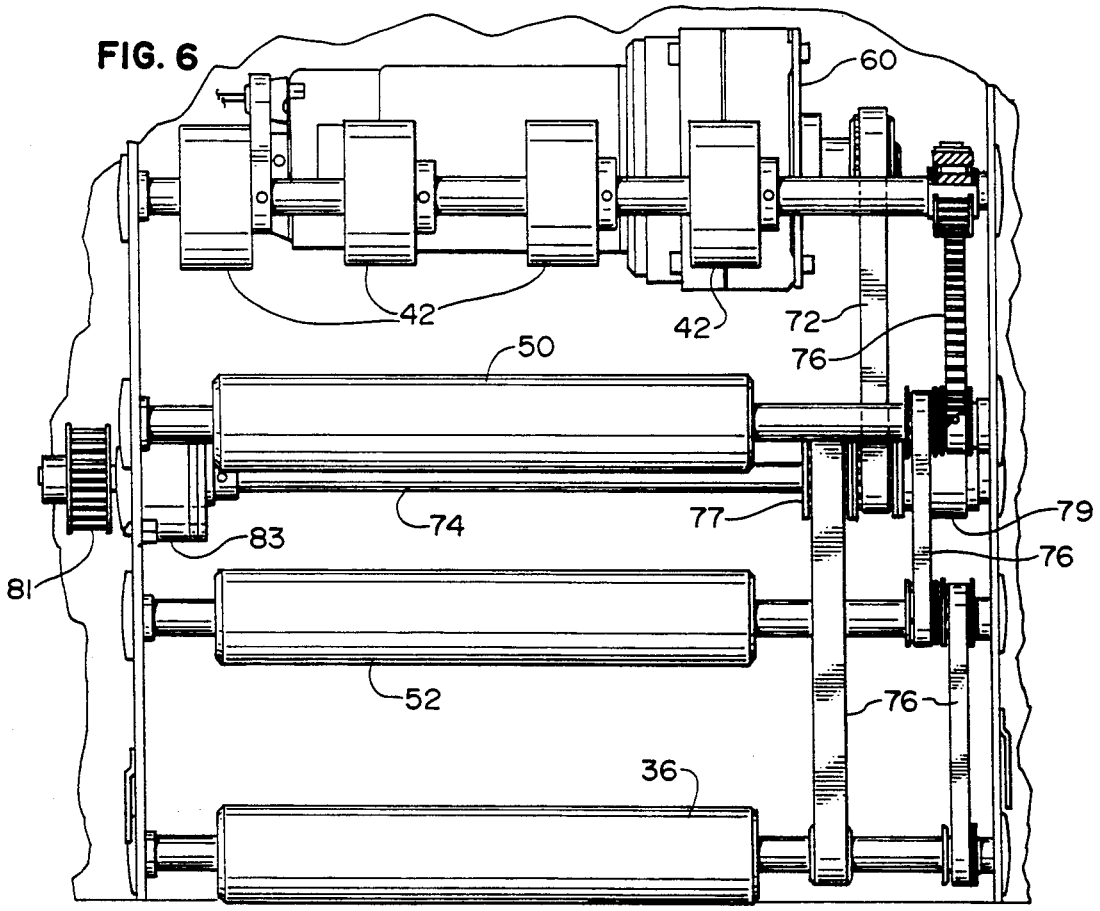
FIG. 6 is a cutaway top view of the machine shown in FIG. 3.
Figure 5:
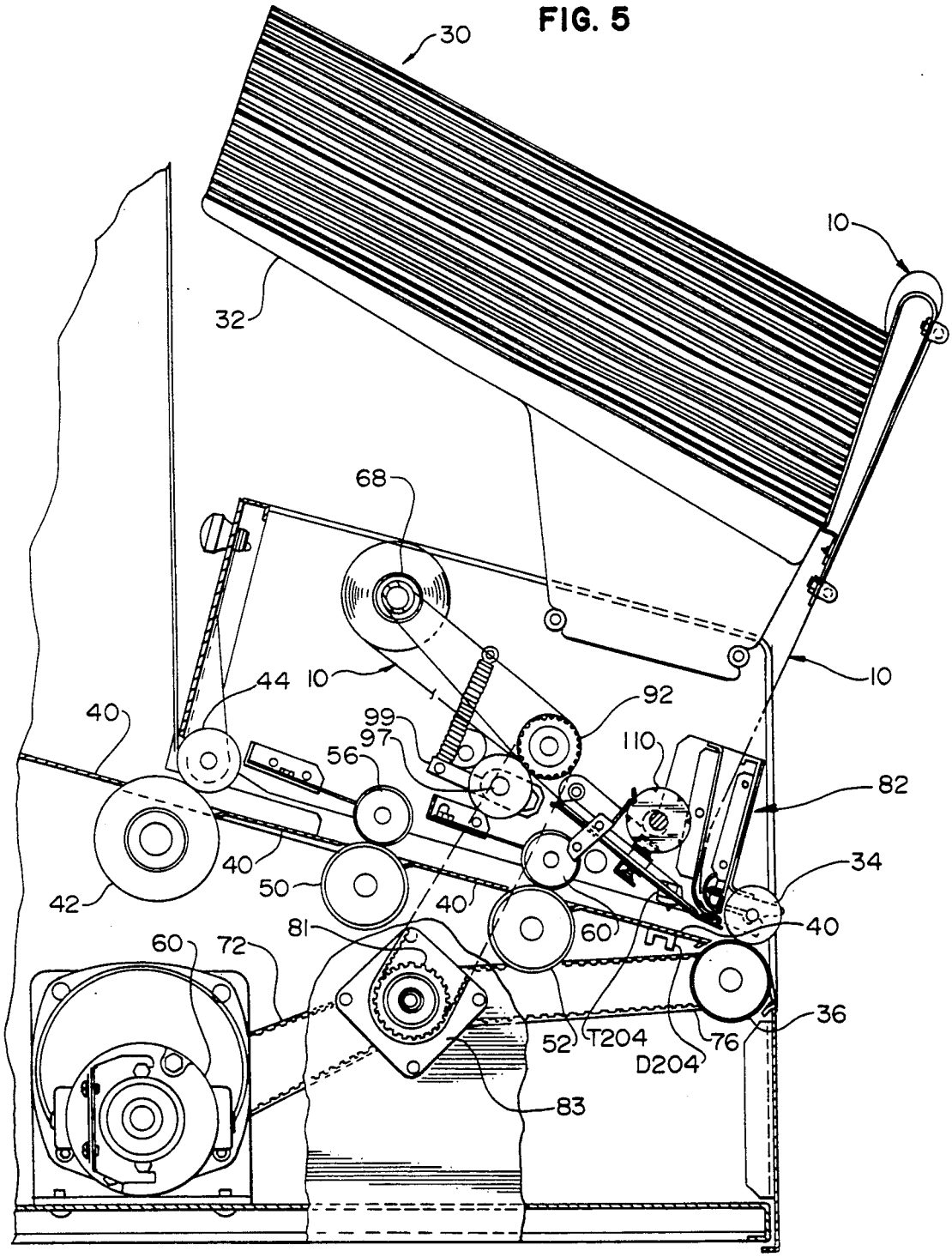
FIG. 5 is a large scale cutaway side view of the far side of the machine shown in FIGS. 2 and 3.

FIGS. 5 and 6 show the drive system for the various rollers. With particular reference to FIG. 6, it will be seen that a motor 60 is positively coupled by a belt 72 to drive a jackshaft 74. A plurality of positive drive belts 76 drive the lower rollers 42,50,52,36.

In particular, the coupled belt pulley pair 77-77 are coaxially mounted about the jackshaft 74 and are collectively coupled thereto by means of a clutch 79 which when energized couples the rotation of the pulleys 77-77 to rotate the jackshaft 74 to drive label drive pulley 81. A brake unit 83 when energized immobilizes the jackshaft 74 and thus the label drive pulley drive 81.

Thus, upon actuating the brake 83 to an "on" condition and the clutch 79 to a decoupled condition, drive power is removed from the label drive pulley 81 driving the label feed roller 92 (FIG. 5), thereby stopping the delivery of a given label 12 to prevent its capture by the exit rollers 34,36. Envelopes 12 are dispensed essentially on an on-the-fly basis without stoppage, and proper placement of leading edges of labels 16 at a chosen distance L (FIG. 1) from leading edges of envelopes 18 is controlled by the timed actuation of the brake 83 and the clutch 79 according to photo electric sensings, as will be subsequently discussed.

Figure 7A:
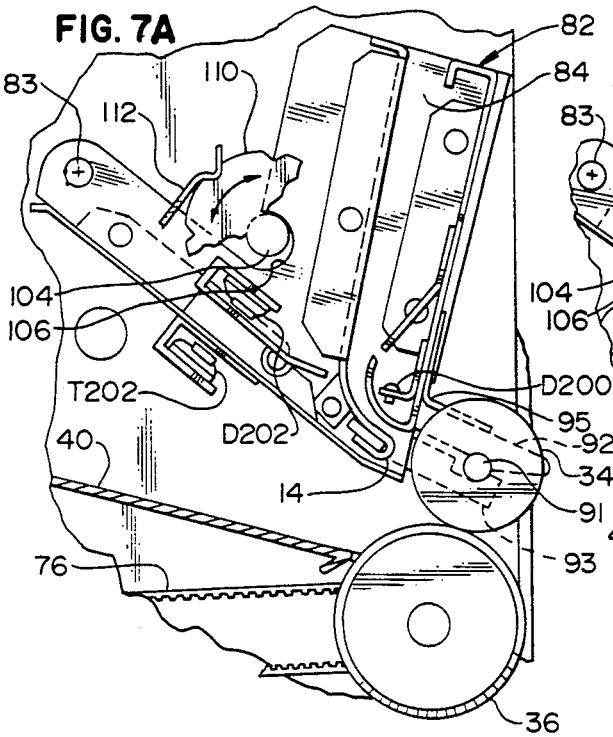
FIGS. 7A and 7B show details of a label dispensing chute adjusted for thin and thick media respectively.
Figure 7B:
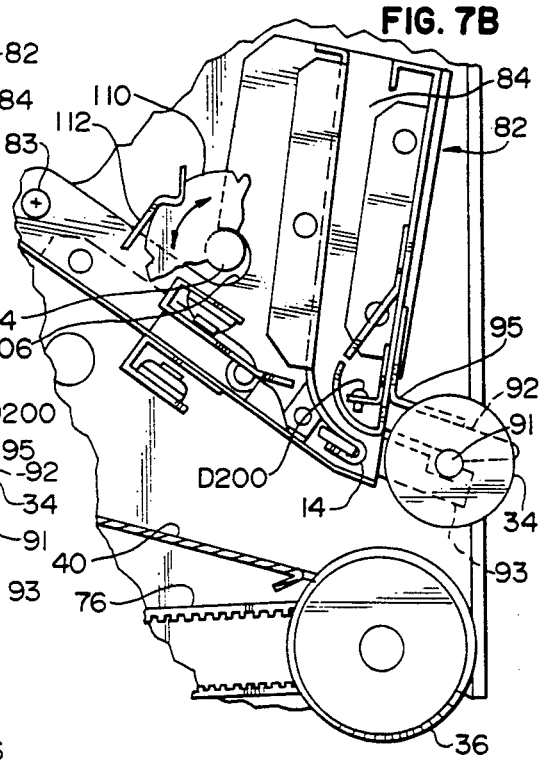

FIGS. 7A and 7B show in greater detail the forward elements of the label feed system, showing in particular a label dispensing head 82 having a dispensing chute 84 for acceptingly guiding the label-bearing web 10 towards and around the arcuate dispensing lip 14 and thereafter back towards the web take-up reel 68. It will be noted that the labels 12 pass between a light emitting diode D200 and a photo transistor T200. A marked reduction in the sensed intensity of the light beam indicates that a label is passing therebetween, the material from which the web 10 is made being at least reasonably translucent. The labelless portion of the web is then passed between a light emitting diode D202 and photo transistor T202 and then to the label take-up reel 68. The purpose of the web-sensing pair D202, T202 will be explained subsequently.

Figure 8:
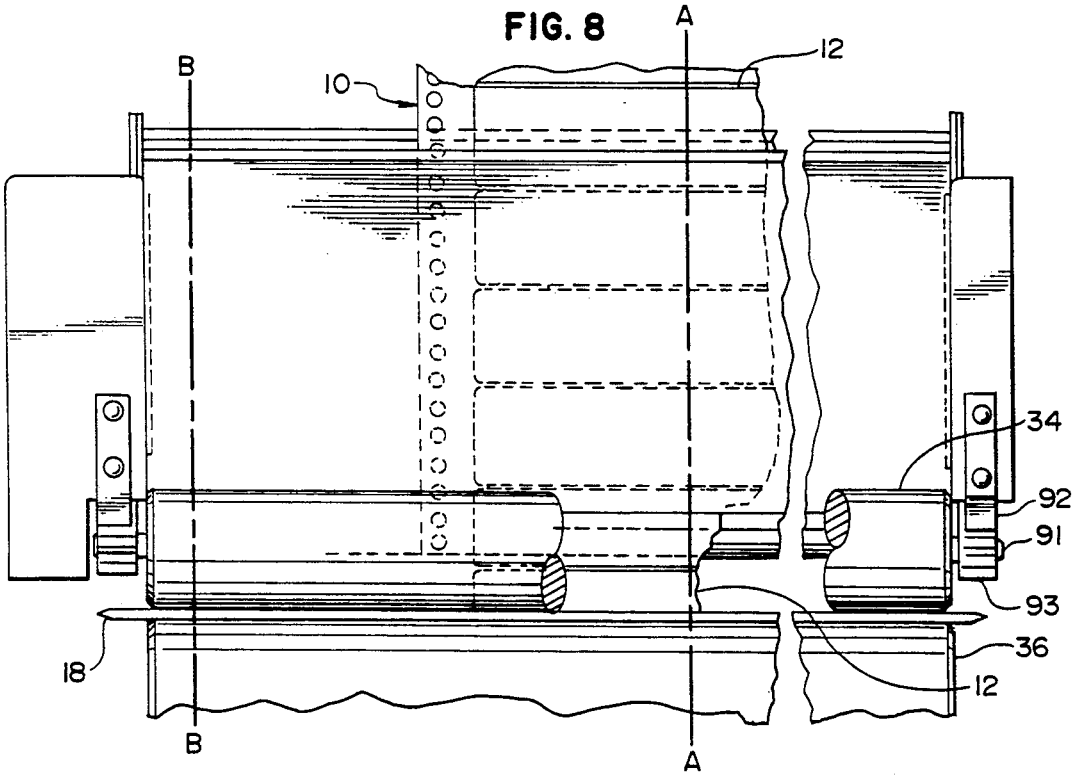
FIG. 8 is partial front elevation view of the machine showing the location of photosensing systems.

FIG. 8 shows axis A-A along which the element pairs D200, T200 and D202, T202 are disposed generally centered on the web 10. A third sensing pair (see FIG. 5) is disposed along axis B—B shown in FIG. 8 and senses the arrival of the leading edge of an envelope 18.

Initial threading of the web 10 through the label feed chute 84 is facilitated by rotation of a manual label feed knob 90 (FIG. 3) manually rotating the label feed roller 92. Threading of the web 10 between the label feed roller 92 and its associated idler 94 is facilitated by the label feed release knob 96 which rotates the idler roller 94 away from engagement with the label feed roller 92 by rotation of an eccentric pin 97 engaging roller mounting arm 99 (FIG. 5). Rotation of the web take-up reel 68 by manual rotation of a web take-up knob 101 removes the slack from the web 10.

To reliably accommodate media of varying thickness, the label dispensing head 82 is mounted for rotation about a pivot 83 (FIGS. 7A, 7B). The dispensing head 82 can set to a variety of angular positions by rotation of a media thickness adjustment knob 102 (FIG. 1) which rotates an offset pin 104 operating against an arcuate cut-out 106, the pin being carried on a detent wheel 110 releasably lockable in a plurality of angular positions by a spring 112. FIG. 7A shows the label dispensing head 82 adjusted for thin media and FIG. 7B shows the head 82 adjusted for thicker media, such as magazines. The upper exit roller 34 is mounted by capture of its associated spindle 91 between resilient upper and lower jaws 92,93 attached to the dispensing head 82. The upper exit roller 34 is thus readily removable to clear label or media fed jams. Additionally, the resilient upper and lower jaws 92,93 provide a limited-motion resilient biasing to maintain proper inter-roller pressure when the chosen height is selected by rotation of the media thickness adjustment knob 102 (FIG. 3). Additional stiffness may be imparted if desired by means of an auxiliary biasing spring 95 affixed to the dispensing head, and engaging the upper surface of the upper jaw 92.

Figure 9:
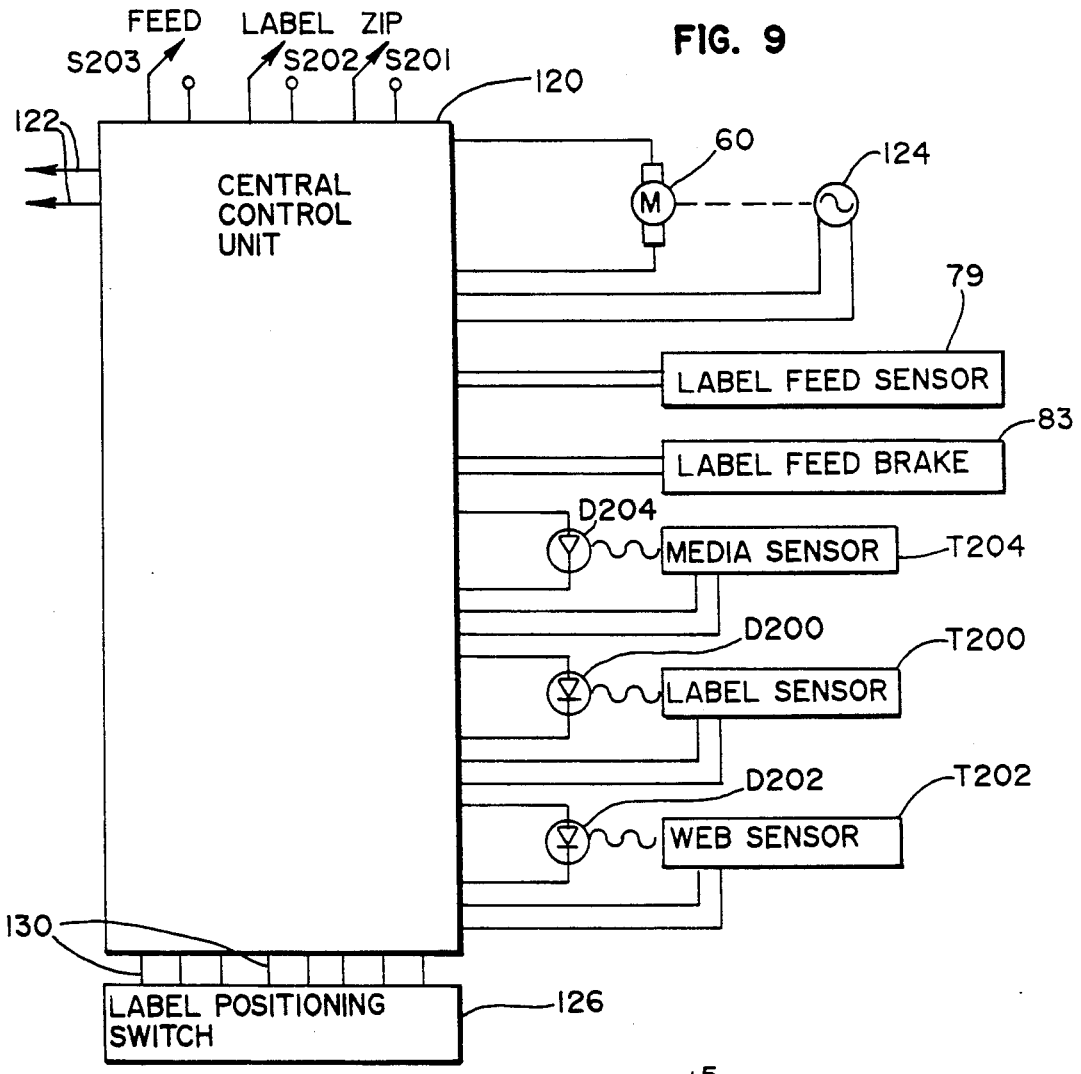
FIG. 9 is a block schematic diagram of the principal control elements of the machine.

Considering next details of the control system, FIG. 9 shows a central control unit 120 powered from power lines 122. The central control unit 120 controllably provides power to the motor 60 responsively to closure of a feed switch S203. A pulse generator 124 is integral with the motor 60, and produces a train of pulses for processing by the central control unit 120. The central control unit 120 also controls the label feed clutch 79 and the label feed brake 83 (FIG. 6). The central control unit 120 provides power to the sensing system diodes D200, D202, D204, and responds to their associated sensing transistors T200, T202 and T204.

A label positioning switch 126, preferably of the rotary variety wherein a binary number may be chosen representing a number ranging from 0 to 255 emplaces a corresponding binary signal on eight lines 130.

As will subsequently be discussed in more detail, a sensing of the appearance of a label leading edge by the label sensor T200 (see also FIGS. 7A, 7B) will cause the drive to the label feed roller 92 (FIG. 5) to be stopped. As previously mentioned, envelopes are fed continuously without regulation, and the position of emplacement of given label 12 on its associated envelope 18 is governed by an elapsed count established by the label positioning switch 126. This count is initiated when an envelope edge appears in front of the envelope sensor T204 and label feed is stopped, and when the appropriate pulse count thereafter from the pulse generator 124 has been achieved, as set by the positioning switch 120, the label drive is once again engaged to feed the label onto its associated envelope at the chosen position.

Figure 10:
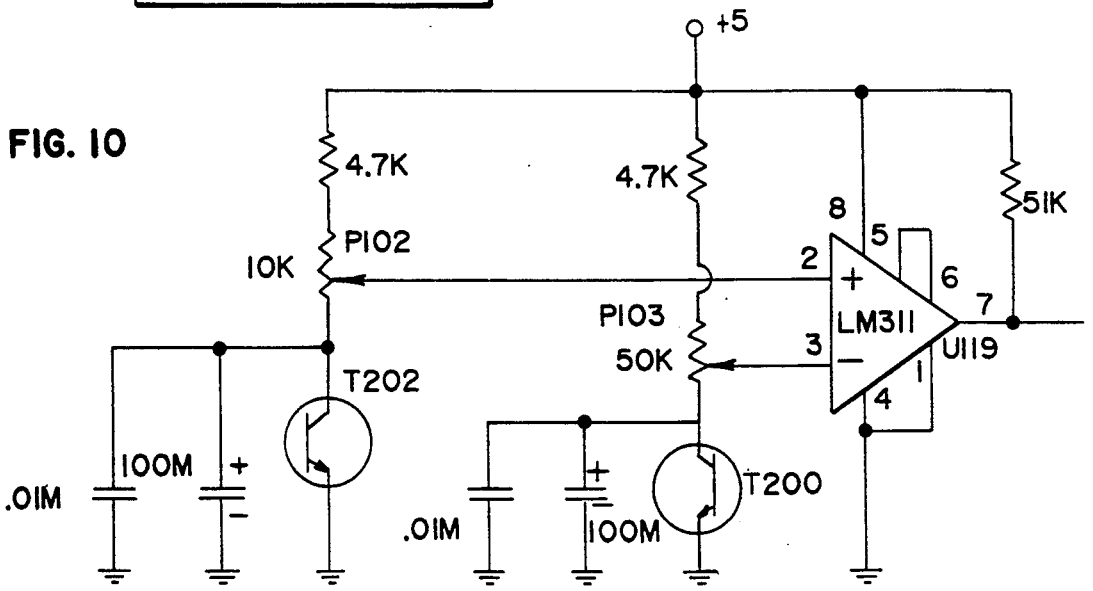
FIG. 10 is a schematic circuit of a label passage sensor.

FIG. 10 shows a portion of the control circuitry used to detect the presence or absence of a label in front of the label sensing transistor T200 (FIGS. 7A, 7B). It will be recalled that the webs 10 are generally translucent and that the labels 12 are reasonably opaque. A reference signal indicative of the optical transmission of the label-free portion of the web is provided by photo transistor T202. This signal level, appropriately adjusted by setting a potentiometer P102 is sent to the non-inverting input of a difference amplifier U119. The photo detector T200 responds to the light transmission passed through the label-bearing portions of the web 10. When a label 12 appears, exitation of transistor T200 is reduced, as a result of which its collector level goes high, resulting in a relatively strong signal applied to the inverting input of the difference amplifier U119. Adjustment of potentiometer P103 sets the gain for this process, and the adjustment of both potentiometers P102, P103 will set the threshold at which amplifier output on line LS goes high responsive to the presence of a label in front of transistor T200. In particular, it will be noted that by providing a reference signal from the label-free web by transistor T202, a wide range of web opacity may be accommodated, since in the absence of a label in front of photo transistor T200, both the input and non-inverting input signal levels will ride up and down together as the web opacity changes from one source of web stock to another. The sensing system is thus automatically self-balancing.

Figure 11:
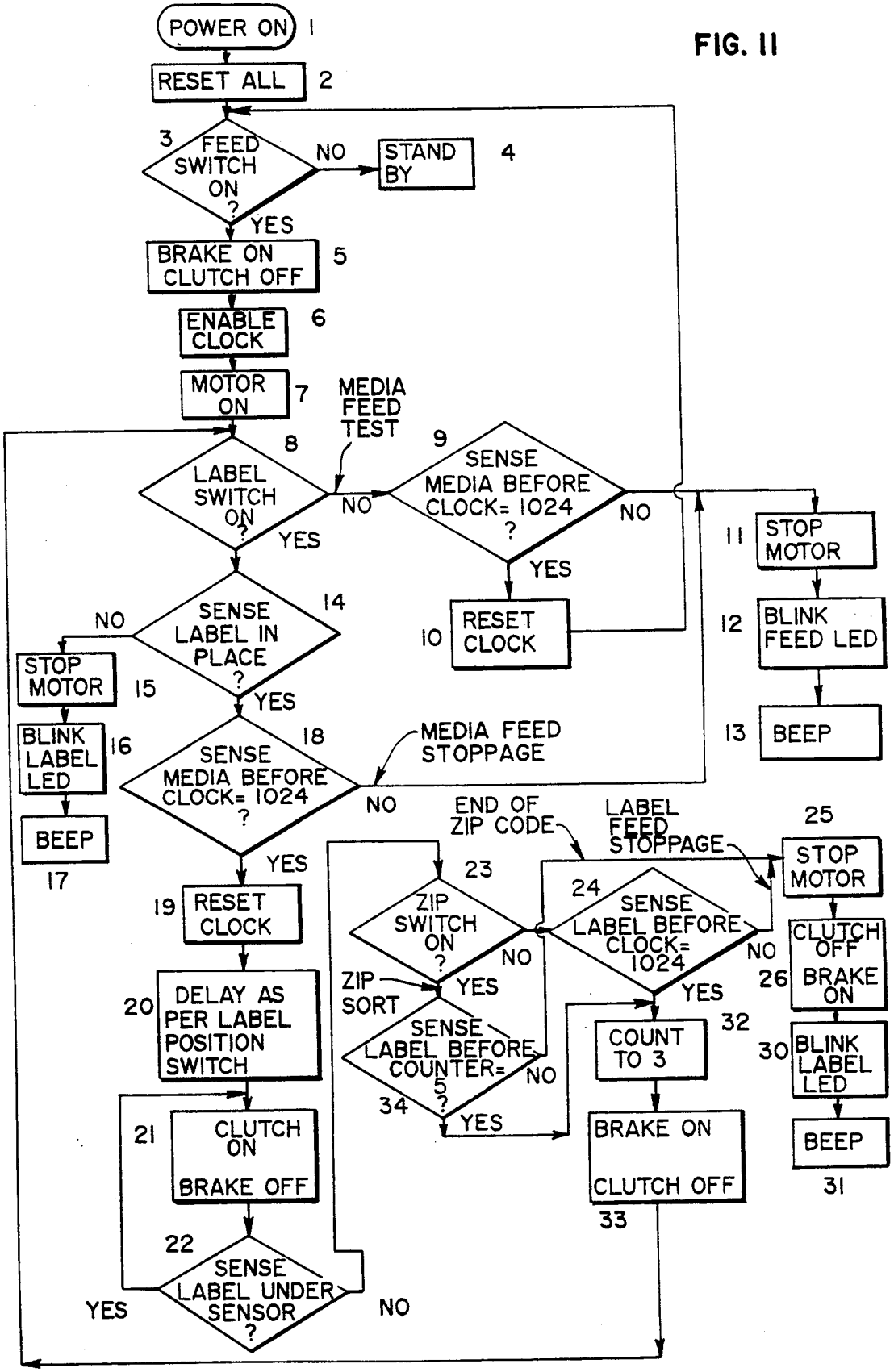
FIG. 11 is a flow diagram of the operation of the control circuit shown in FIG. 9; and, FIGS. 12A–12D are schematic diagrams of a circuit implementing the flow diagram shown in FIG. 11.

FIG. 11 shows a flow chart corresponding to the control circuit schematics shown in FIGS. 12A–12D. Although in the exemplary form of the invention the decisions are principally hard-wired, it will be evident to those skilled in the art that microprocessor control may readily be implemented. Three counters or clocks govern the synchronization of all operations. One is a 1,024 count clock used to sense media feed stoppage and label feed stoppage, and further used to govern the previously mentioned delay in the feed of a pre-positioned label for subsequent feed to its associated envelope. Another is a count-of-3 clock used to cause a label to be advanced a slight amount after initial sensing by label detect transistor T200. This is done simply to ensure that reliable signal margins are maintained. Finally, a count-of-5 clock is used to govern a sorting operation. The nature of this sorting operating is to sort envelopes into appropriate groups, as for example, according to the zip codes on the labels, by putting all addresses of a common zip code in a common block on the web 10, and by providing an oversize inter-label gap when the zip code changes from one block to the next. This may be done by controlling the printing of the labels so that when the zip code changes, a blank label is created, and this blank label is peeled off by the operator when the label web stack 30 is emplaced on the machine 20. Failure of a new label to appear before the count-of-5 clock has run out subsequent to disappearance of a previous label will cause a sorting action to occur. In the present invention, this sorting action is simply done by shutting down the motor drive; however, alternative mechanical feed chute sorting systems may readily be adapted to the present invention.

Considering the flow chart of FIG. 11 in more detail, the system goes through power-up reset on steps 1 and 2, resetting the clocks. Actuation of the motor feed switch at step 3 causes the jackshaft brake 83 to be turned on and the clutch 79 to be disengaged. The clock (i.e., 1,024 clock) is now enabled, and after turning on the motor at step 7 the pulses from the pulse generator 124 are fed to the clock. Provision is made for an initial media feed test to ensure that the media are feeding properly before beginning the label affixing operation. This is done by turning a label feed switch off. If the switch is not on, branching occurs to step 9 to test media feed.

Each clock pulse corresponds to an advance of 1/32 inch, and if the media sensing transistor T204 has not detected the arrival of the next envelope before the count reaches 1,024, media stoppage has occurred, and branching occurs to a stop routine indicated by steps 11,12,13. If, on the other hand, the media arrive before the clock runs out, then the clock is reset at step 10, branching occurs back to step 3, and the cycle repeats until the operator is assured that the media feeding system is working properly.

At this point, the label switch is turned on. The system must be previously initialized for a labelling run by advancing the web 10 until a label passes the label sensor T200. If there is no label in place, then system shutdown occurs when the label switch is closed, as indicated by steps 15,16,17. Otherwise, the media feed stoppage test is carried out at step 18 as in step 9. If an envelope is not detected by sensor T204 by the time the clock runs out, system shutdown occurs as before. If, on the other hand, the next element of media arrives before the clock runs out, the clock is reset and a delay is counted in terms of clock pulses until the number of clock pulses equals the number set into the central control unit 120 (FIG. 9) by the label position switch 126. At this time the label feed brake 83 is released, the clutch 79 is engaged as indicated at step 21, and a continuous interrogation senses for disappearance of the label. Once the trailing edge of the label being emplaced disappears from under the label sensor T200, breakout occurs from this loop.

We shall assume for the moment that the previously mentioned zip sorting mode is not required, i.e., a zip code switch is not on as indicated in step 23. At step 24 a test is made for label feed stoppage, or an end-of-web condition. If a new label is not sensed before the clock runs out, then system shutdown is carried out as indicated by systems 25,26,30,31. If, however, the next label arrives before the clock runs out, then the count-of-3 cycle is initiated to feed approximately 3/32 inch of label edge beyond the label sensor T200, and the label feed is then immobilized as indicated in step 33. Branching then returns to repeat the cycle starting at step 8.

If, on the other hand, zip sort is required, then branching from step 23 will go to step 34 and a count of 5 is initiated, corresponding to an inter-label gap of 5/32 of an inch, more than that normally present on the web 10 shown in FIGS. 1 and 2. If, as previously indicated, blank labels have been interposed between blocks of labels having different zip codes, and these blanks have previously been removed from the web, then this large gap will cause a count of 5 to be detected without sensing another label, resulting in termination of the run by branching to steps 25,26,30,31. If the next label is of the same zip code, no such large gap is present, and program flow branches to step 32 repeating a 3 count initial positioning advance of the next label, and the cycle repeats as previously described.

Figure 12A:
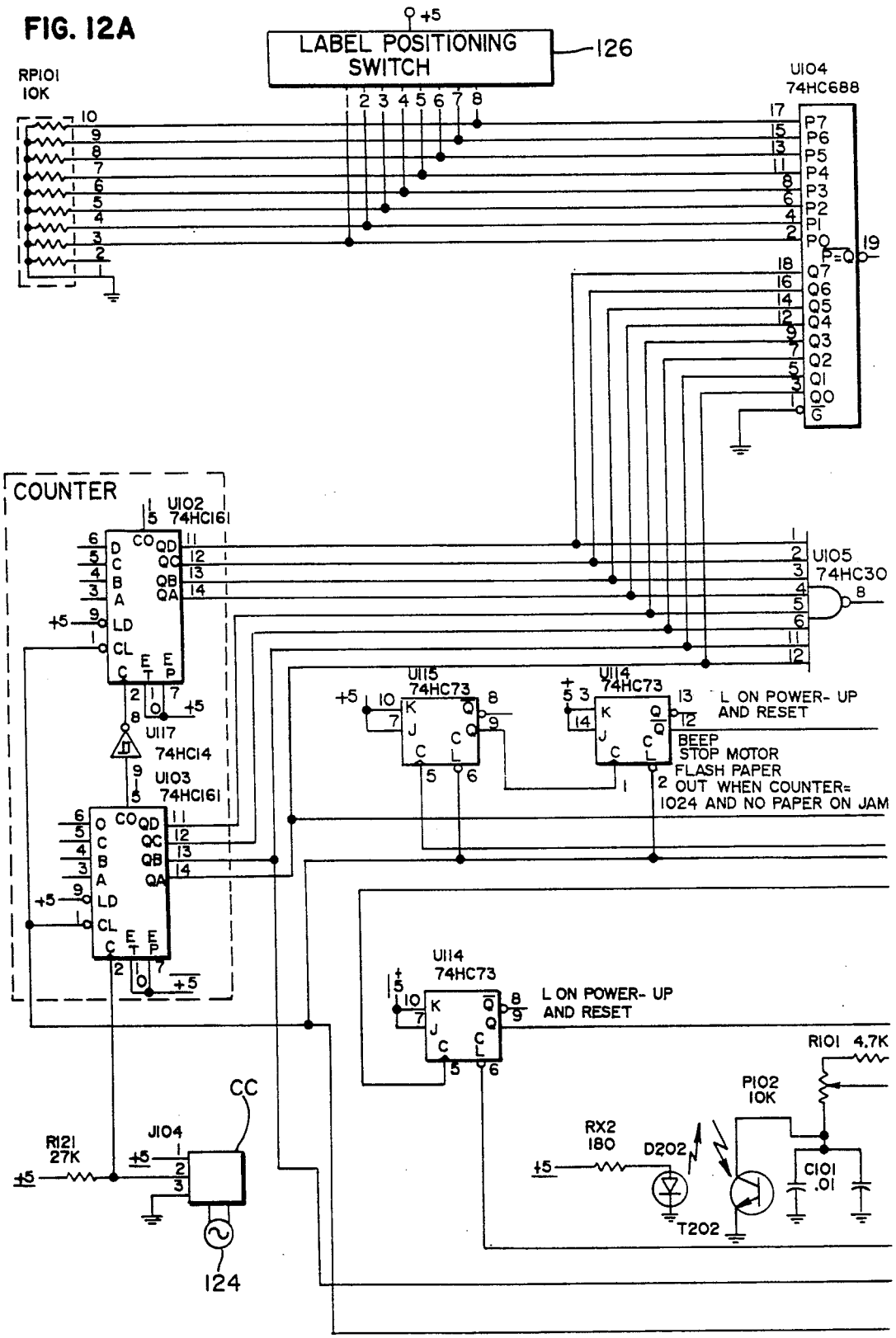
Figure 12B:
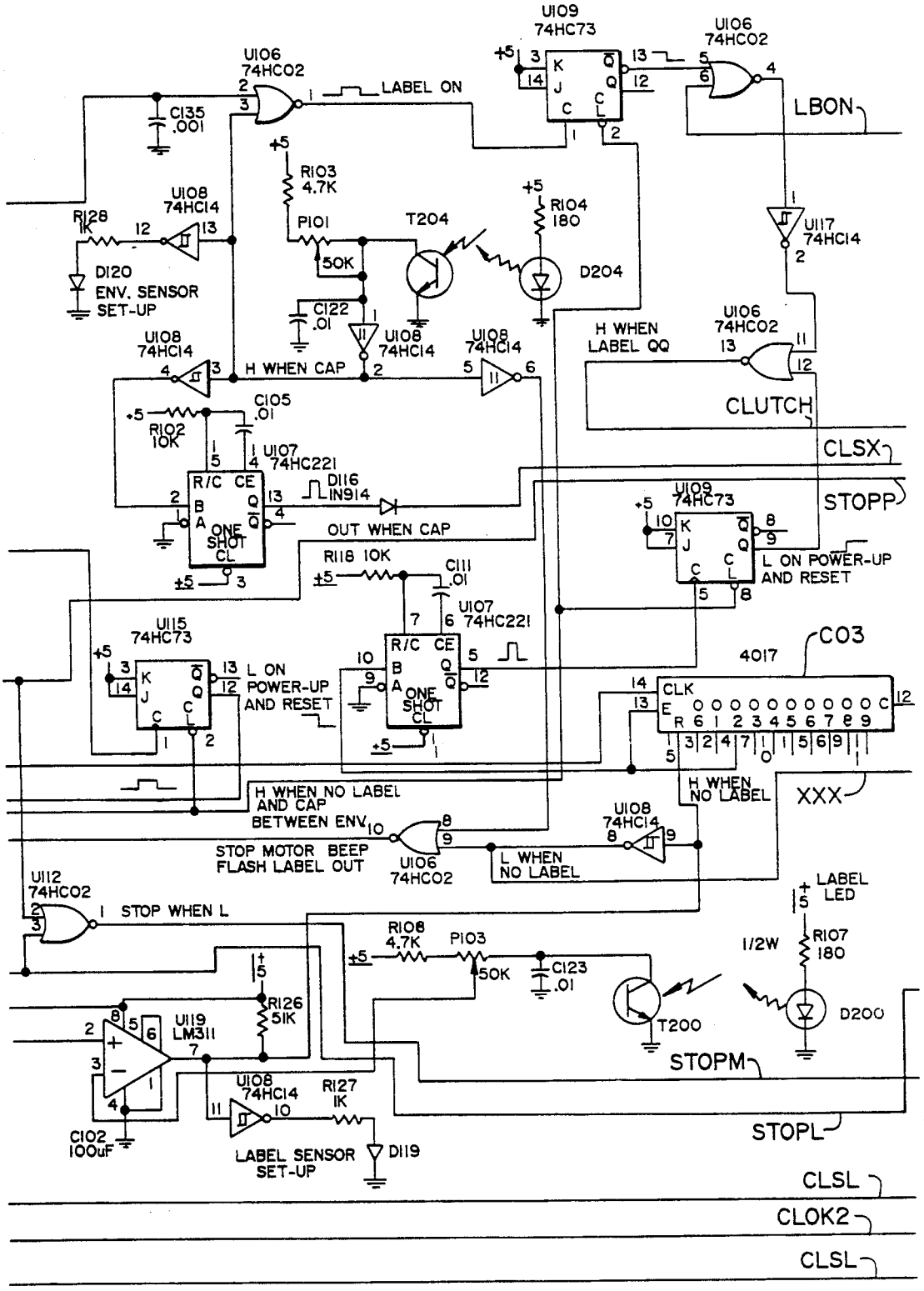

FIGS. 12A–12D show the schematic diagram of the central control unit 120. It will be noted that the sensing circuit shown in FIG. 10 is replicated in the lower portions of FIGS. 12A and 12B. The 3 count as previously mentioned governs many of the operations, as is evident from the flow diagram (FIG. 11) previously discussed. Referring first to FIG. 12A, pulses from the motor-driven pulse generator 124 are fed through a control circuit CC appropriately shaping the pulses, which are then fed to a scale of 256 counter consisting of two scale of 8 counters U102, U103. The current count is fed along 8 lines to terminals Q0–Q7 of comparison gate U104. The label positioning switch 126 establishes on eight control lines appropriate high and low states corresponding to the chosen label delay count. This information is fed to terminals P0–P7 of comparison gate U104. Output terminal 19 of U104 will go low only when a binary number received at pins Q0–Q7 is identical with that established at pins P0–P7. This serves to actuate the brake 83 and clutch 79 to feed the labels 12 onto their envelopes 18 as previously described.

The count of 1,024 is achieved by passing the outputs of the two counters U102, U103 through a 12 terminal NAND gate U105. A change of state occurs at the output U105 at every count of 256. These changes of state are fed through 3 serial flip-flop units U115, U114, U116 to produce a count of 1,024 signal state on line STOPP. The counters giving the count of 1,024 are reset with each envelope sensing by transistor T204. The count of 3 counting cycle is provided by counter C03 shown in FIG. 12B. This counter is cleared and reset to 0 whenever a label leaves the sensing area in front of the label sensing transistor T200, i.e., when the output of comparator U119 goes high, and begins to count when the next label is sensed, as indicated by initiation of a low state at the output of comparator U119. Counter C03 freezes on a count of 3 and stops the label feed by actuating the brake solenoid BS and clutch solenoid CS (FIG. 12D). The speed of the motor 60 (FIG. 12D) is governed by a motor speed controller MSC.

Figure 12C:
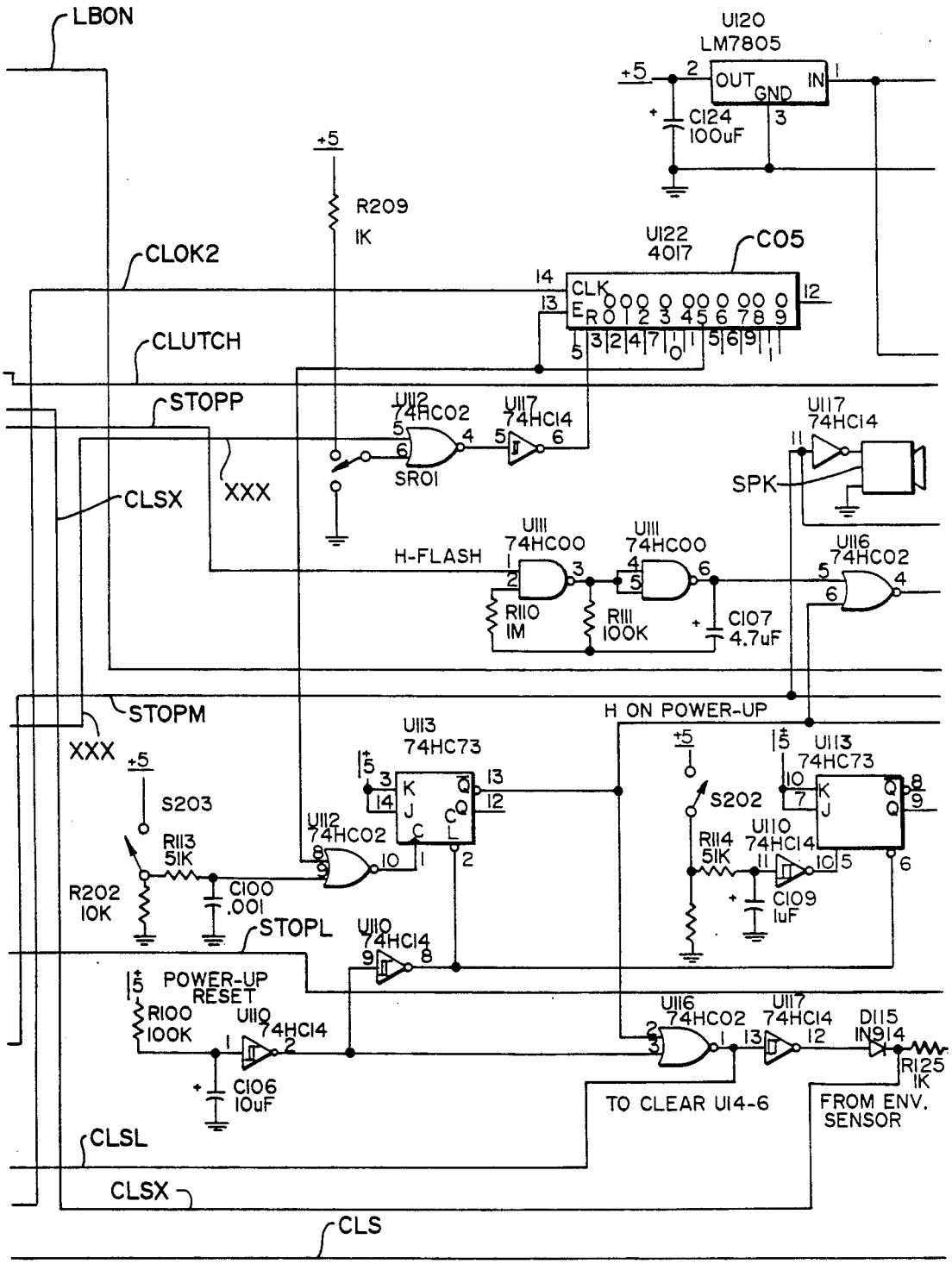
Figure 12D:
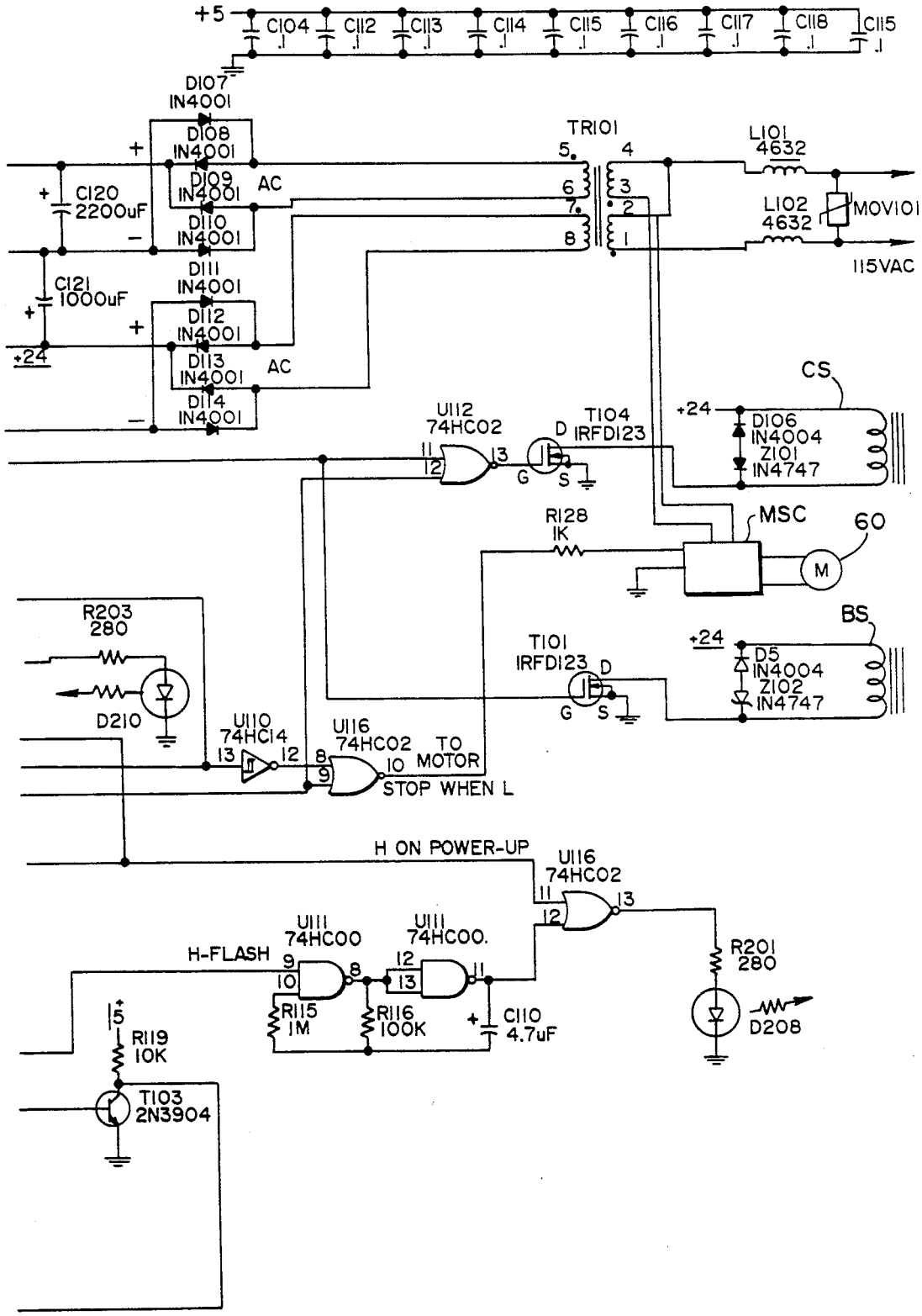

The count of 5 provision is provided by counter C05 shown in FIG. 12C. This counter is reset to 0 when the trailing edge of a label passes beyond transistor T200, i.e., a gap between the labels is sensed as evidenced by a high state at the output of comparator U119. Counting begins immediately. If a label is sensed before a count of 10, counter C05 is disabled. If, on the other hand, a count of 10 is achieved, system shutdown is triggered by appearance of a high state at pin 5 of C05. Suitable system warnings and status indications are provided by buzzer SPK and light emitting diodes D208, D210.

FIG. 3 shows the arrangement of various control elements just described as mounted on a control panel 130 of the central control unit 120. The label position 126, switches S201, S202 and S203 are emplaced on the panel 130. There is also shown a control knob 132 associated with the motor speed controller MSC (FIG. 12D) for varying the motor speed. Optional features include a power-on light 134, a label counter 136, and a counter reset switch 138.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

We claim:

1. In a label applying machine for fixing labels to moving pieces of sheet material which in successive runs of the machine can have widely varying thicknesses, said labels being located at longitudinally spaced points on one side of a label-carrying web, each label having on one side thereof a surface of adhesive material removably securing said label to said web and which label peels from the web when the web is sharply reversely bent away from the side of the web carrying the same; said machine including a first feeding apparatus for sequentially advancing said pieces of sheet material to a label-applying station, a second feeding apparatus for advancing said web to said station and reversely bending said web so said labels peel from said web with the adhesive side thereof confronting said pieces of sheet material delivered sequentially to said label-applying station, and a pair of label-pressing rollers at said label-applying station between which the peeling label and the leading piece of sheet material are delivered, the improvement comprising:

a support frame for one of said rollers;

a support frame mount configured for movement of said one of said rollers progressively toward and away from the other of said rollers to control the spacing between said pair of rollers;

a roller mount resiliently mounting one of said rollers for limited movement towards and away from the other of said rollers; and a manually operable actuator for progressively moving said frame over a plurality of discrete stable positions to vary the separation between said rollers to provide the optimum spacing between said pair of rollers so that the desired amount of pressure is provided for reliably pressing the adhesive side of a peeling label upon the confronting side of the piece of sheet material at said label-applying station.

2. The label applying machine of claim 1 wherein said support frame mount is configured to support said frame for pivotable movement about a pivot point spaced from said label-applying station, and said roller mount resiliently rotatingly affixes said one of said rollers to said frame.

3. The label-applying machine of claim 2 wherein said manually operable actuator for moving said frame about said pivot point includes a rotatable cam configured for engagement with said frame for moving said frame about said pivot responsively to rotation of said cam over a range of cam positions.

4. The label-applying machine of claim 3 including multiple spring-loaded detents associated with said cam for releasably locking said cam in a series of fixed positions over said range of cam positions.

5. In a label-applying machine for sequentially affixing to pieces of sheet material customer addressed labels removably adhesively secured in longitudinally spaced relation by a layer of adhesive to one face of a web of translucent material, adjacent labels on said web containing addresses with identical area mailing designation and being separated by a given similar spacing, groups of labels with different mailing-designations being separated from each other by a substantially greater spacing to indicate the points of separation of said groups, said machine including a controllable first feeding apparatus for sequentially advancing said pieces of sheet material to a label-applying station and thereafter to a given delivery station, a controllable second feeding apparatus for advancing said web, removing said labels, and emplacing said labels on successive pieces of sheet material at said label-applying station, and a feed controller for controlling said first and second feeding apparatus to govern the region of emplacement of said labels on said workpieces, the improvement comprising:

a sorting apparatus responsive to the passage past a given point of an adjacent pair of labels separated by said substantially greater spacing for providing a sorting control signal condition indicative of the termination of a group of labels having a common area mailing designation, said sorting apparatus including at least one optical transmission sensor for sensing changes in optical transmission when said spaces in label-bearing regions of said web move therepast and a sorting control system responsive to said sensing changes for providing said sorting control signal condition responsively to the passage of a pair of adjacent labels spaced apart by said substantially greater spacing so as to interrupt the operation of said first and second feeding apparatus to terminate delivery to said station.

6. The label affixing machine of claim 5 including a timer for timing the duration of gap-indicating signals from said optical sensing means and configured to respond to detection of a gap-indicating signal condition of substantially greater duration than that corresponding to the passage of labels separated by said given similar spacing.

7. The label applying machine of claim 2 including a blade mounted to said frame and proximate to said one of said rollers for providing an edged surface, said second feeding apparatus being configured to draw said label-carrying web around said blade to dispense said labels serially towards said one of said rollers.

* * * * *